US008783084B2

(12) United States Patent
Etienne

(10) Patent No.: US 8,783,084 B2
(45) Date of Patent: Jul. 22, 2014

(54) SUPPLY STATION

(75) Inventor: Joël Etienne, Saint Die des Vosges (FR)

(73) Assignee: Numalliance SAS, Saint Michel sur Meurthe (FR)

( * ) Notice: Subject to any disclaimer, the term of this patent is extended or adjusted under 35 U.S.C. 154(b) by 533 days.

(21) Appl. No.: 12/933,987

(22) PCT Filed: Mar. 2, 2009

(86) PCT No.: PCT/FR2009/050337

§ 371 (c)(1),
(2), (4) Date: Sep. 22, 2010

(87) PCT Pub. No.: WO2009/118495

PCT Pub. Date: Oct. 1, 2009

(65) Prior Publication Data

US 2011/0027057 A1 Feb. 3, 2011

(30) Foreign Application Priority Data

Mar. 27, 2008 (FR) ..... 08 51974

(51) Int. Cl.
*B21F 23/00* (2006.01)

(52) U.S. Cl.
CPC ..... *B21F 23/00* (2013.01)
USPC ..... 72/246; 72/226; 72/251; 226/187

(58) Field of Classification Search
CPC ..... B21D 3/02; B21B 1/16; B21B 1/18; B21F 23/00; B21F 23/002
USPC ..... 72/246, 251, 184, 135, 226, 234, 245, 72/237; 414/46.7; 470/147; 226/181, 186, 226/187
See application file for complete search history.

(56) References Cited

U.S. PATENT DOCUMENTS

| | | | | | |
|---|---|---|---|---|---|
| 2,541,232 | A | * | 2/1951 | Forster | 140/1 |
| 3,339,393 | A | * | 9/1967 | Rice | 72/240 |
| 3,534,689 | A | * | 10/1970 | Barthalon | 104/89 |
| 3,683,662 | A | * | 8/1972 | Dechene et al. | 72/235 |
| 3,757,552 | A | * | 9/1973 | Ritter et al. | 72/8.3 |
| 3,762,202 | A | * | 10/1973 | Sherwood | 72/245 |
| 4,194,541 | A | * | 3/1980 | Ditges | 140/147 |
| 4,939,919 | A | * | 7/1990 | Chezzi | 72/181 |
| 5,025,648 | A | * | 6/1991 | Matsuoka | 72/134 |
| 5,090,279 | A | * | 2/1992 | Enzinger | 82/152 |
| 5,363,681 | A | * | 11/1994 | Speck et al. | 72/129 |

(Continued)

FOREIGN PATENT DOCUMENTS

JP 60-33806 A * 2/1985 ..... B21B 13/00

*Primary Examiner* — Edward Tolan

(74) *Attorney, Agent, or Firm* — Egbert Law Offices, PLLC

(57) ABSTRACT

The invention relates to a wire feed station of a wire shaping machine, said station including grooved rollers functioning in pairs and rotating in reverse directions with respect to each other. The wire is clamped between said rollers by these moving closer to one another. Both rollers of the same pair of driving rollers are supported at the front of the same bearing block unit, said bearing block being elastically deformable to absorb a relative movement of the rollers. Preferably, said bearing block also supports an endless transmission screw on which are engaged a couple of transmission wheels coaxial with the driving rollers which they drive into rotation. More particularly, a bearing block is deformed so that a relative movement of the rollers results in a rotation-deformation of the bearing block about the transmission screw axis.

4 Claims, 3 Drawing Sheets

(56) References Cited

U.S. PATENT DOCUMENTS

| | | | | |
|---|---|---|---|---|
| 6,019,366 | A * | 2/2000 | Tranquilla | 271/274 |
| 6,151,942 | A * | 11/2000 | Itaya | 72/137 |
| 6,502,446 | B2 * | 1/2003 | Potthoff | 72/224 |
| 6,606,894 | B1 * | 8/2003 | Wu | 72/137 |
| 6,697,556 | B1 * | 2/2004 | Militaru et al. | 385/100 |
| 6,923,034 | B2 * | 8/2005 | Matsuoka | 72/137 |
| 7,322,220 | B2 * | 1/2008 | Park et al. | 72/234 |
| 7,692,117 | B2 * | 4/2010 | Belfiore et al. | 219/137.7 |
| 8,146,397 | B2 * | 4/2012 | Penttilä et al. | 72/246 |
| 8,479,548 | B2 * | 7/2013 | Ishibashi et al. | 72/79 |
| 2003/0221473 | A1 * | 12/2003 | Matzen | 72/186 |
| 2004/0065130 | A1 * | 4/2004 | Itaya | 72/137 |

* cited by examiner

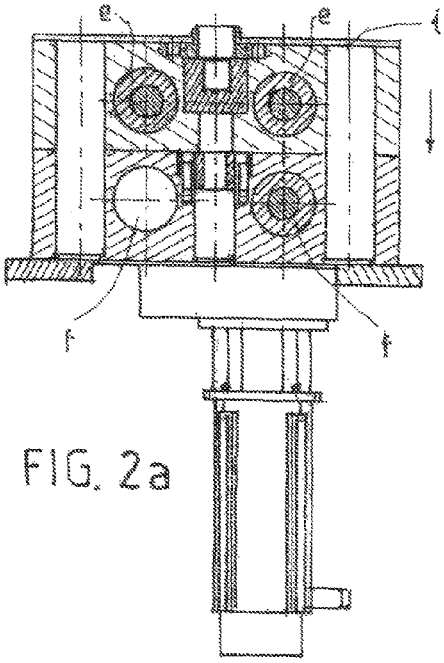
FIG. 2a
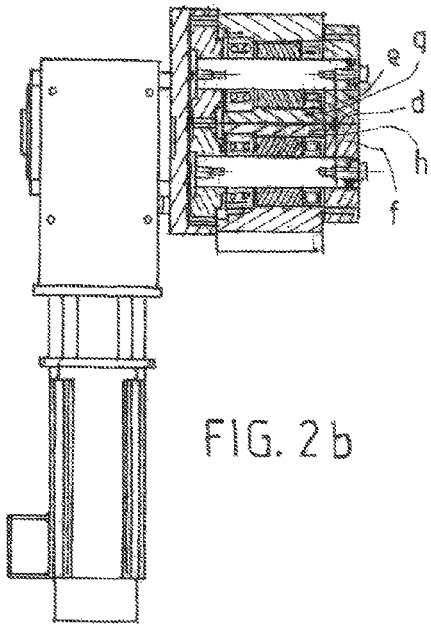
FIG. 2b
FIG. 1a
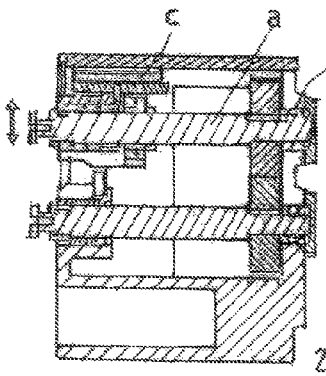
FIG. 3
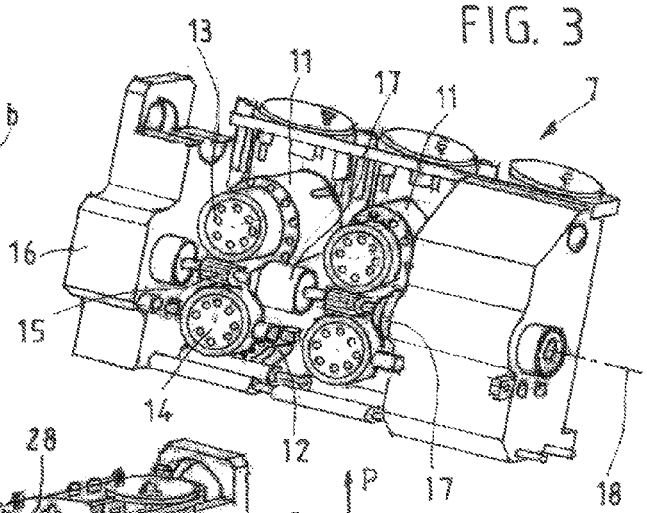
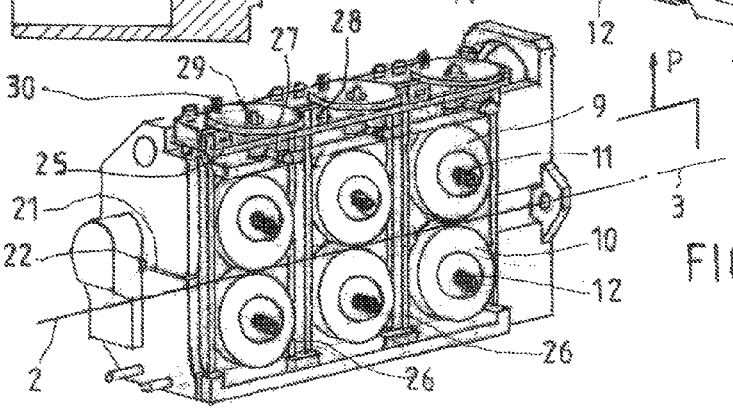
FIG. 4

SUPPLY STATION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a feed or supply station in a metal wire shaping machine.

2. Description of Related Art Including Information Disclosed Under 37 CFR 1.97 and 37 CFR 1.98.

A numerically controlled machine carries out various shaping operations on a metal wire (or on a bar), such as for example cambering, bending, etc. . . . , executed by various stations mounted on a frame.

The word metal wire is a generic term professionally used, which means a wire proper as well as a bar or a tube.

One of the stations is the wire feed station which horizontally supplies said wire along a travel axis, to the tools of a shaping station.

The wire is moved by the feed station using grooved rollers functioning in pairs and rotating in reverse directions with respect to each other, generally the rollers are positioned one above the other, with a stationary lower roller and an upper roller which can be moved vertically in one direction and the other.

The wire is clamped between said two rollers by these moving closer to one another and it is placed in the annular grooves of said rollers.

The movable roller is actuated by an actuator which defines the tightening stress on the wire and which can be a screw, a pneumatic or hydraulic jack, an eccentrics system or any other system.

The number of roller pairs varies as a function of the wire diameter and/or the shaping operations to be carried out thereon.

Two mountings of the rollers of the same pair of rollers are possible. First, a mounting wherein the shafts supporting the rollers are mounted in two bearings, with a rear bearing of at least one of the shafts which must be swivelling, which causes, when the rollers come closer to each other, a shears effect, through the misalignment of the peripheral annular grooves of the rollers between which the wire travels. Such defect tends to rotate the wire about the travel axis thereof, during the feeding of the wire and generates dispersions between the parts manufactured downstream on the shaping station. A mounting of this type is shown as an example in appended FIG. 1*a*, with a feed device wherein the shaft (a) of the upper roller (not shown) is mounted on a swivelling bearing, i.e. mounted on a spherical bearing (b) and actuated by a pneumatic actuator (c).

Second, a mounting wherein the shafts supporting the rollers are each mounted in a single bearing, and wherein the relative movement thereof requires guiding means such as, for example, columns, guiding blocks or any other one. In such a type of mounting, the slightest clearance in said guiding means (for example mounting clearance and/or wearing clearance) generates a misalignment of the rollers peripheral grooves and thus generates the same defects as with the previous mounting. A mounting of this type is shown, as an example, in FIGS. 2*a* and 2*b*, wherein the wire (d) is clamped between two pairs of rollers (e, f). Two rollers (e, f) of the same pair are mounted on a single bearing with two guiding bearings (g, h) in the same part, with the guiding means being a guiding column (i).

For both above-mentioned types of mounting, the number of parts required for guiding the shafts is significant, which implies a long chain of dimensions and a poor guiding final accuracy which is not satisfactory, considering the reproducibility of the parts to be shaped.

The aim of the invention consists in solving the problems of the feed devices of the prior art by limiting the number of parts as well as limiting the clearances which generate the shear effect.

BRIEF SUMMARY OF THE INVENTION

This aim is reached by a wire feed station of a wire shaping machine, said station including grooved rollers functioning in pairs and rotating in reverse directions with respect to each other, with the wire being clamped between said rollers by these moving closer to one another, characterized in that both rollers of the same pair of driving rollers are supported at the front of the same bearing block unit, said bearing block being elastically deformable to absorb a relative movement of the rollers. Preferably, said bearing block also supports an endless transmission screw whereon engage two transmission wheels coaxial with the driving rollers they drive into rotation.

More particularly, a bearing block is deformed so that a relative movement of the rollers results in a rotation-deformation of the bearing block about the transmission screw axis.

BRIEF DESCRIPTION OF THE DRAWINGS

The invention and the advantages thereof will be better understood when reading the following description and referring to the appended drawings, wherein:

FIG. 1*a* is a vertical sectional view of a feed device of the prior art with a swivelling shaft;

FIGS. 2*a* and 2*b* are a front vertical sectional view and a vertical cross-section of a feed device with a single bearing;

FIGS. 3 and 4 are schematic front and rear views of a device according to the invention, with three bearing blocks with two rollers;

DETAILED DESCRIPTION OF THE INVENTION

Figure 5:
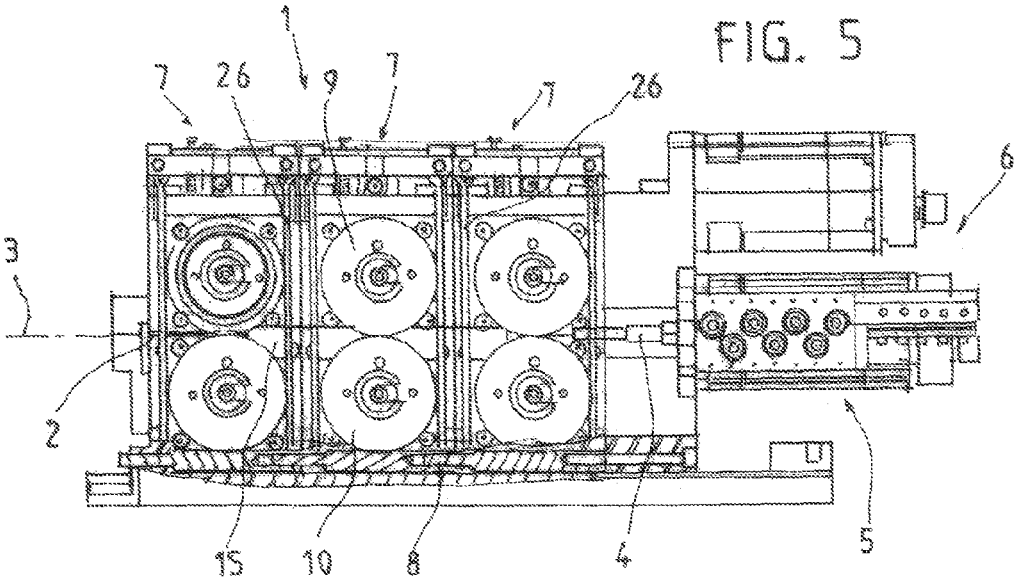
FIG. 5 is a vertical sectional view along the travel plane.
Figure 6:
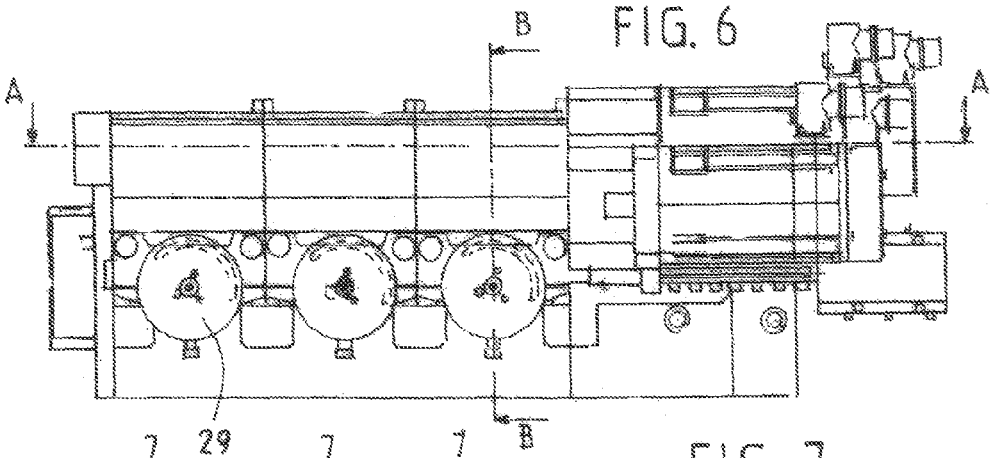
FIG. 6 is a top view of the present invention.
Figure 7:
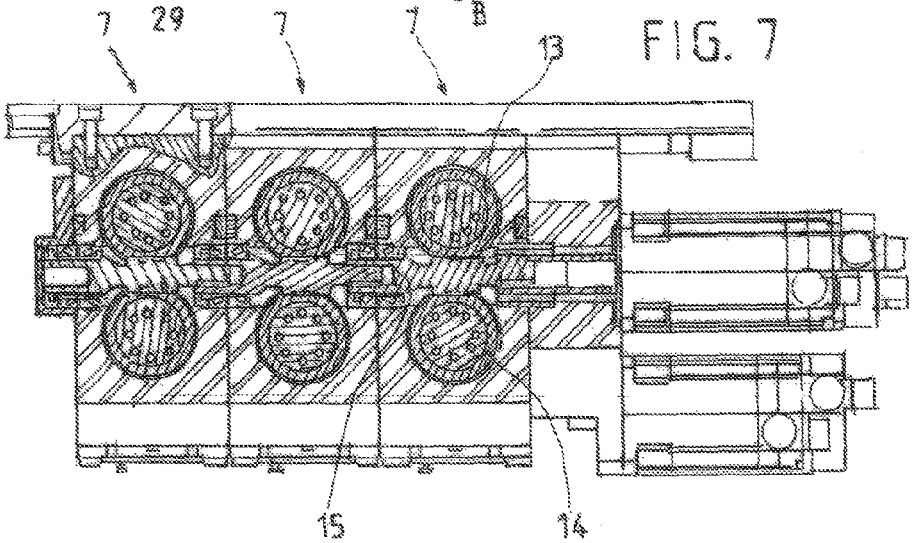
FIG. 7 is a vertical sectional view along AA in FIG. 6.

A machine according to the invention is partially shown in FIGS. 5 to 8 which is a non limiting exemplary embodiment.

It includes a feed station 1 which guides a wire 2 along a horizontal travel axis 3 successively through a straightener 5, then a jig bushing 4 prior to entering the feed station, then in a shaping station 6 not shown in detail.

The feed station 1 shown includes three bearing block units as 7 (with this number not being limiting) associated together by tie rods 8.

A bearing block unit 7 according to the invention will now be described. It includes a lower grooved roller 10 and an upper grooved roller 9 positioned vertically one above the other, with the peripheral guiding grooves being in the same vertical plane (P) also called the guiding plane.

The rollers 9 and 10 are respectively supported and guided by an upper bearing 11 and a lower bearing 12 supported at the front of the bearing block and are driven into rotation by an upper transmission wheel 13 and a lower transmission wheel 14 which are engaged in an endless transmission screw 15 driven into rotation by a motor which is not shown in the Figures and positioned at the end of the transmission screw, under a casing 16.

The endless screw 15 is supported by two side bearings 17 which hold the stationary horizontal axis thereof parallel to the travel axis 3 at the back thereof.

It should be noted that, on the one hand, the upper wheel 13 and the upper bearing 11 are mounted on a common axis 19, that, on the other hand, the lower wheel 14 and the lower bearing 12 are mounted on a common axis 20 and that the configuration of the bearing block unit 7 enables a relative movement of both axes 19 and 20.

Figure 8:
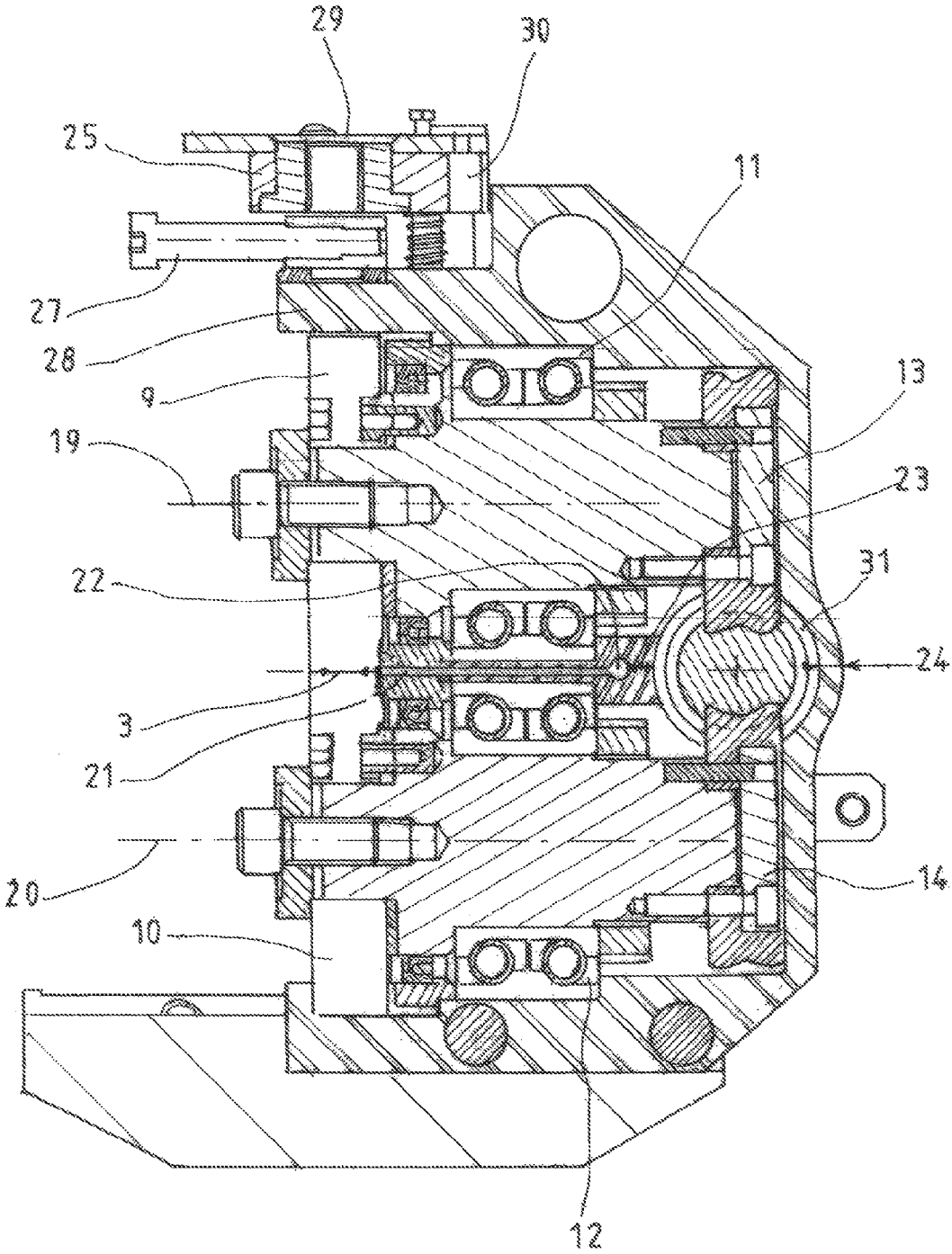
FIG. 8 is a vertical sectional view along BB in FIG. 6.

Such relative movement is generated by the fact that the bearing block is deformable thanks to the horizontal plane slot 21 opening into the front of the block and limited rearwards by a circular hole 22 opening laterally into either side of the bearing block (refer to FIGS. 4 and 8).

The bearing block 7 is deformed when compressing the rollers 9, 10 by compression means to create a bending-rotation about the endless screw rotation axis (18).

The bending-rotation means will be described first.

The circular hole 22 is parallel to the axis 18 of a bore 19 of the bearing block, wherein the endless screw 15 rotates, and at a distance thereto which is computed so as to provide for a wall 23 thickness at the front of the hole 19 which is equivalent to the wall 24 thickness at the rear of the hole 19.

The dimension of such wall 23 or 24 thickness is computed by the manufacturer, according to the elasticity factor of the material the bearing block 7 is made of, and according to the hole 19 diameter.

As a non limitative example for a bearing block made of aluminium and a hole, 44 mm+/−0.2 in diameter, a thickness 23 or 24 of 6 mm+/−0.1 is provided for.

Roller compression means will now be described.

A horizontal spreader beam 25 provided on the top of the bearing block is supported by two vertical bars 26 made of steel. A stretching screw 27 positioned between the spreader beam 25 and a shoulder 28 of the bearing block unit 7 makes it possible to lift or to lower the spreader beam 25.

The bars 26 are configured as straps at the upper end thereof and are used as springs, securing the stress exerted by the rollers on the wire 2.

The bearing block further includes index shifting means 29 to apply a predetermined tightening stress. Such means 29 is for example a toothed wheel blocked by a shouldered base 30 mounted on a spring. The knurl can be rotated, then locked again in another predetermined position by releasing the base.

The upper roller 9 can be positioned closer to or further from the lower roller 10 by acting on the stretching screw 27, without modifying the meshing of the upper 13 and lower 14 wheels on the driving screw 15.

The tightening amplitude of the rollers is limited by the construction thereof to the required minimum to release or tighten the wire within the range of the dimension tolerance thereof.

With the numerical values given hereabove as a non limitative example, the tightening amplitude is measured in the plane (P) and amounts to 0.25 mm on either side of the feed axis 3, i.e. a total amplitude of the order of 0.5 mm.

With respect to the prior art, the roller moving means are suppressed and replaced by an elastic deformation of a single bearing block supporting the shafts of two rollers and absorbing the movement of the rollers caused by the elastic deformation of said bearing block.

The deformation is computed to result in a rotation about the axis of the driving screw, which does not, on the one hand, modify the flank clearance and thus the meshing of the transmission, and, on the other hand, reduces the chain of dimensions between both shafts since it is reduced to the distance between said shafts.

Such configuration makes as compact a machine as possible, particularly as regards to the overall dimensions of the required rollers, as far as stress and meshing are concerned, and thus makes it possible to optimize the reduction in inertia of the whole driving chain, and thus to increase dynamics.

Such compact configuration makes it possible to reduce the number of parts and to increase accuracy in the positioning of the rollers with a reduced chain of dimensions.

In addition, such configuration is modular since it makes it possible to couple several bearing block units 7 together as per the specifications of work to execute and/or the wire to be shaped. As a non limitative example, the Figures show three bearing block units coupled together by conventional coupling means known to the persons skilled in the art to form a feed station to be fixed onto the frame of the shaping machine.

The invention claimed is:

1. A wire feed station for a wire shaping machine, the wire feed station comprising:

a plurality of pairs of grooved rollers in which the grooved rollers of each pair rotate in opposite directions, each pair of grooved rollers suitable for clamping wire between the rollers by moving the rollers toward each other;

a plurality of bearing blocks respectively supporting said plurality of pairs of grooved rollers at a front thereof, each bearing block of said plurality of bearing blocks being elastically deformable so as to absorb a relative movement of the respective pair of grooved rollers on the bearing block;

a plurality of pairs of transmission wheels arranged coaxially and respectively with the pair of grooved rollers on said plurality of bearing blocks, the transmission wheels suitable for driving the grooved rollers in rotation; and a transmission screw supported by the bearing block, said transmission screw engaged with the pair of transmission wheels, the bearing block being deformable such that a relative movement of the rollers results in a rotational deformation of the bearing block about an axis of said transmission screw.

2. The wire feed station of claim 1, said bearing block having a horizontal planar slot opening at a front of the bearing block, said planar slot extending rearwardly so as to open at a rearward end to a circular hole, said circular hole opening laterally to either side of the bearing block.

3. The wire feed station of claim 1, further comprising:

a spreader beam supported by a bar and moved by a stretching screw, said spreader beam affixed to the bearing block.

4. The wire feed station of claim 1, said plurality of bearing blocks having units thereof coupled together.

* * * * *